US007178756B2

(12) United States Patent
Reinke

(10) Patent No.: US 7,178,756 B2
(45) Date of Patent: Feb. 20, 2007

(54) AUTOMATIC PERFORATED WEB SPLICING SYSTEM

(75) Inventor: Stephen M. Reinke, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/084,570

(22) Filed: Mar. 18, 2005

(65) Prior Publication Data

US 2006/0208128 A1 Sep. 21, 2006

(51) Int. Cl.
*B65H 19/00* (2006.01)
*B65H 69/06* (2006.01)

(52) U.S. Cl. ..... 242/554.1; 242/556; 242/566; 242/563

(58) Field of Classification Search ..... 242/554, 242/554.1, 554.2, 554.4, 556, 566, 563
See application file for complete search history.

(56) References Cited

U.S. PATENT DOCUMENTS 4,029,538 A 6/1977 Vance, Jr. ..... 156/502
5,197,688 A * 3/1993 Giorgio et al. ..... 242/562
5,679,207 A 10/1997 Palone et al. ..... 156/507
6,015,114 A * 1/2000 Randazzo et al. ..... 242/559.2
6,192,955 B1 * 2/2001 Rice ..... 156/351
6,817,566 B2 11/2004 Clifford et al. ..... 242/552

FOREIGN PATENT DOCUMENTS

EP 0496 393 B1 1/1995
WO WO 9111380 A * 8/1991

* cited by examiner

*Primary Examiner*—Kathy Matecki
*Assistant Examiner*—William E. Dondero
(74) *Attorney, Agent, or Firm*—Stephen H. Shaw

(57) ABSTRACT

An automated perforated web splicing system includes a web stock roll of a perforated web, supported on a single unwind spindle, and having both a precut web leader edge and a web trailer edge for splicing. Also included in the automated perforated web splicing system is a leader holder device for automatically acquiring and positioning the web leader edge of the web stock roll according to perforations in the perforated web, and a splicing station for automatically positioning the web trailer edge prior to splicing and performing an on-pitch splice according to perforations in the perforated web.

8 Claims, 19 Drawing Sheets

AUTOMATIC PERFORATED WEB SPLICING SYSTEM

FIELD OF THE INVENTION

The invention relates generally to the field of automatic web splicing, and in particular to splicing of perforated web. More specifically, the invention relates to automatically acquiring the web leader from a wound stock roll of perforated web, and automatically splicing the web leader to the trailer of a previously unwound stock roll of perforated web, while maintaining the perforations in pitch.

BACKGROUND OF THE INVENTION

An exemplary perforated web has one or more rows of perforations along its entire length, often used to engage a sprocket, which is often used to advance the perforated web through a device or process. For example, motion picture film (web) has perforations, which are used to advance the film (web) through a film projector system in a controlled fashion. The perforations, which are in a row or multiple rows, are evenly spaced along the entire length of the perforated web. It is preferable to maintain the same perforation pitch between the perforations adjacent to each side of a splice, so the splice section of a perforated web advances effectively through any sprocket type device. Splices, which are not accurately spliced on pitch, or are not accurately aligned laterally, can cause a variety of web conveyance problems, or create damage to the web itself.

Many commercially available ultrasonic splicing systems, similar to what is described in U.S. Pat. No. 4,029,538 and European Patent No. EP 0 496 393 A1, are often used to splice webs together, such as polyester webs used as motion picture film. These systems require an operator to manually insert both a web trailer and a web leader into a splicing apparatus. An operator also registers both the web leader and web trailer perforations, to maintain the perforations pitch, by placing the two webs against pin type locating features. The operator trims the web trailer end and the web leader end with a web-cutting device, to form an on-pitch overlap splice. Next, the operator discards these trimmed web ends. An operator has to physically actuate a device to overlap the web ends to the desired on-pitch overlap position. The operator then activates an ultrasonic splicing device. When the ultrasonic splicing is completed, the spliced web is manually removed from the splicing device. This overall splicing operation is very manually intensive and the rate and accuracy of generating a splice is dependent on the skill of the operator. For motion picture film splicing, the splicing operation is sometimes done in the dark, due to the inherent light sensitivity of unprocessed motion picture film, which increases the difficulty of manual splicing. Fully automating this web handling and ultrasonic splicing operation is very desirable, because it would eliminate the manual labor required, and provide splices at fast and consistent rates.

Many automated web stock roll unwind and splicing systems have been developed, for example, as seen in U.S. Pat. Nos. 6,817,566 B2 and 5,679,207. Often these systems require two stock roll unwind spindles, which requires loading stock rolls at two different locations. A dual spindle unwind system can add complexity in tooling and system controls. Also, if one desires to automatically load web stock rolls onto a dual unwind system, there is added complexity to automatically load two spindles.

Even when the web stock rolls are manually loaded onto web stock roll unwind and splicing systems having dual unwind spindles, the dual spindle system can be problematic. Often the dual spindles are located side by side, which requires additional floor space. Alternatively, the dual spindles are placed one over the top of another, thereby creating operator-handling problems, because one spindle is located too high or too low for proper manual loading. Therefore, the simplicity of a single unwind spindle system remains very desirable.

Consequently, there is a need for automatic web splicing systems, which can accurately splice a leader of a wound stock roll of perforated web to the trailer end of a previously unwound stock roll of perforated web. There is a need for a system that can accurately splice two perforated webs on pitch (such as webs of motion picture films).

There is also a need to be able to automatically acquire the leader of a web stock roll and splice the leader from the web stock rolls of varying diameters and of varying rotational orientations. There is a desire to provide an automatic splicing system, which requires minimal space. Finally, there is a need for a simple and low cost system, which will be reliable in operation.

SUMMARY OF THE INVENTION

The present invention is directed to overcoming one or more of the problems set forth above. Briefly summarized, according to one aspect of the present invention, an automated perforated web splicing system, includes a web stock roll of a perforated web, supported on a single unwind spindle, and having both a precut web leader edge and a web trailer edge for splicing. Also included in the automated perforated web splicing system is a leader holder device for automatically acquiring and positioning the web leader edge of the web stock roll according to perforations in the perforated web, and a splicing station for automatically positioning the web trailer edge prior to splicing and performing an on pitch splice according to perforations in the perforated web.

These and other aspects, features and advantages of the present invention will be more clearly understood and appreciated from a review of the following detailed description of the preferred embodiments and appended claims, and by reference to the accompanying figures. Identical reference numerals have been used, where possible, to designate identical elements that are common to the figures.

ADVANTAGEOUS EFFECT OF THE INVENTION

The present invention provides a fully automated splicing system, which can perform the required operations quickly and at a consistent rate.

The present invention provides only one unwind spindle and associated drive. This approach simplifies the system controls, reduces hardware costs and can reduce required floor space. Also, having one unwind spindle reduces the complexity of any automatic stock roll loading system.

The use of a precut prepared web stock roll leader with a leader adhesive feature facilitates an automatic means of acquiring the web leader and accurately positioning it at the splice station.

The present invention does not require cutting the web, or removal of trimmed web within the splicing system. This greatly simplifies the splicing system, and improves its reliability.

One embodiment of the present invention mechanically registers the web perforation pitches on each side of the splice, and holds the web, which is adjacent to each side of an ultrasonic horn, tightly. This method of registering the web perforation's pitches can reduce variability in pitch and lap splice dimensions verses using a system that only uses optical sensors to locate perforations.

The present invention does not require pushing the web into tracks, which is often unreliable, due to stubbing and buckling of the web. The trailer and leader web ends are always pulled to positions, and both web ends are positioned under tension.

When the web stock roll is loaded, it does not need to be oriented rotationally on the unwind spindle in the present invention, and does not require the operator to perform any pre-thread (or staging) of the web leader. This greatly simplifies the requirements for the overall stock roll loading process.

The present invention can automatically accommodate large variations in stock roll diameters.

The present invention can accurately laterally position the web trailer and web stock roll leader edges inline, even when the lateral sidewall position of the incoming web stock roll varies in flatness or position (by +/−0.125" variation, for example).

A preferred embodiment of the present invention uses an ultrasonic splicing process; therefore, no splice tape, which is a consumable, is required. Therefore, there are no problems which results from feeding and replenishing splice tape.

DETAILED DESCRIPTION OF THE INVENTION

General Description

Figure 1:
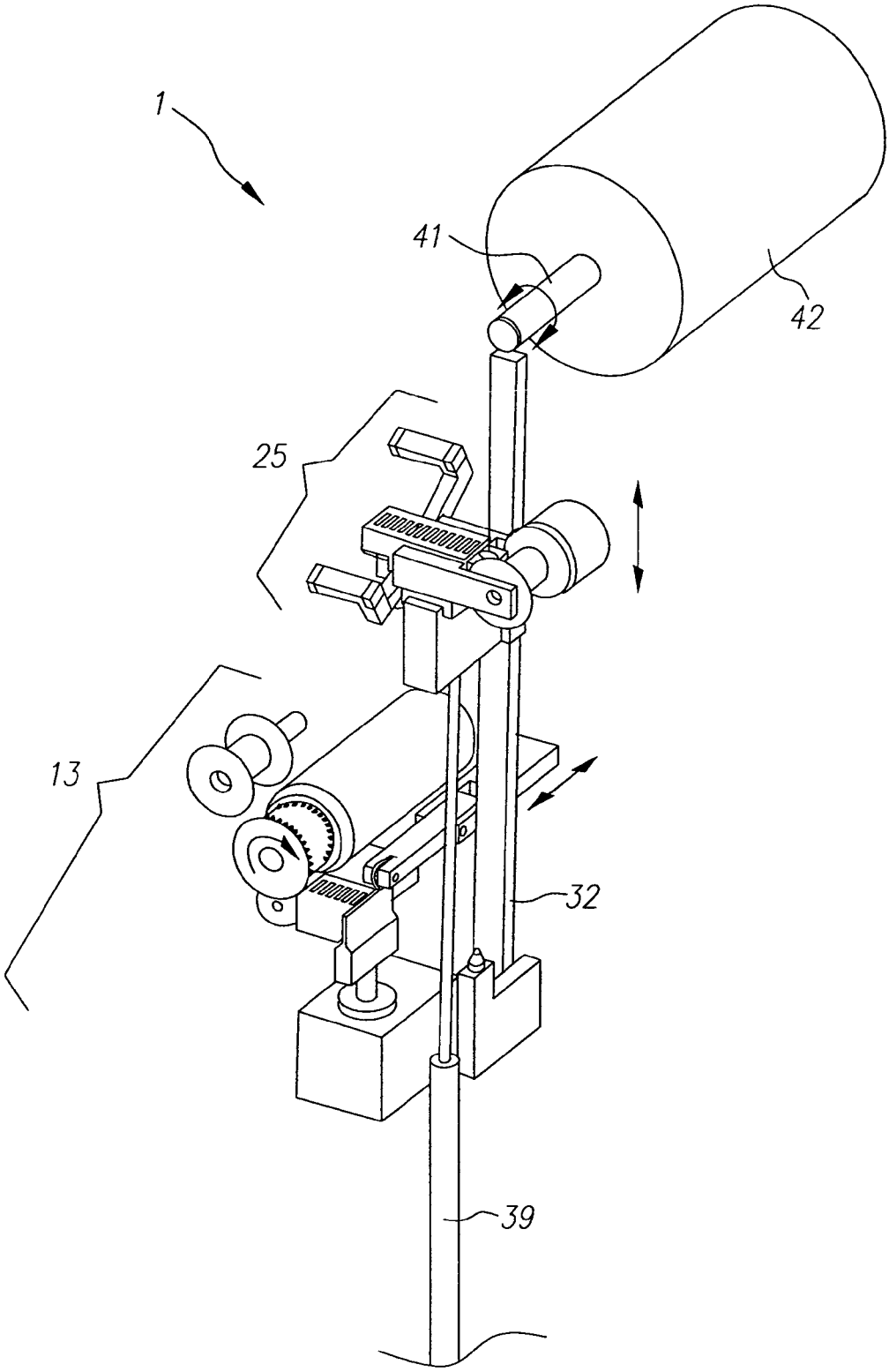
FIG. 1 is a perspective view of an automated web splicing system 1, with a web and web stock roll 2 removed for clarity.

One exemplary embodiment of the automatic web splicing system 1, shown in FIG. 1 (and herein alternatively referred to as the "system"), includes an ultrasonic splicing station 13, a leader holding device 25, and an unwind spindle 41 driven by an unwind drive 42, which are all supported by a frame (not shown) within the automatic web splicing system 1.

Figure 4:
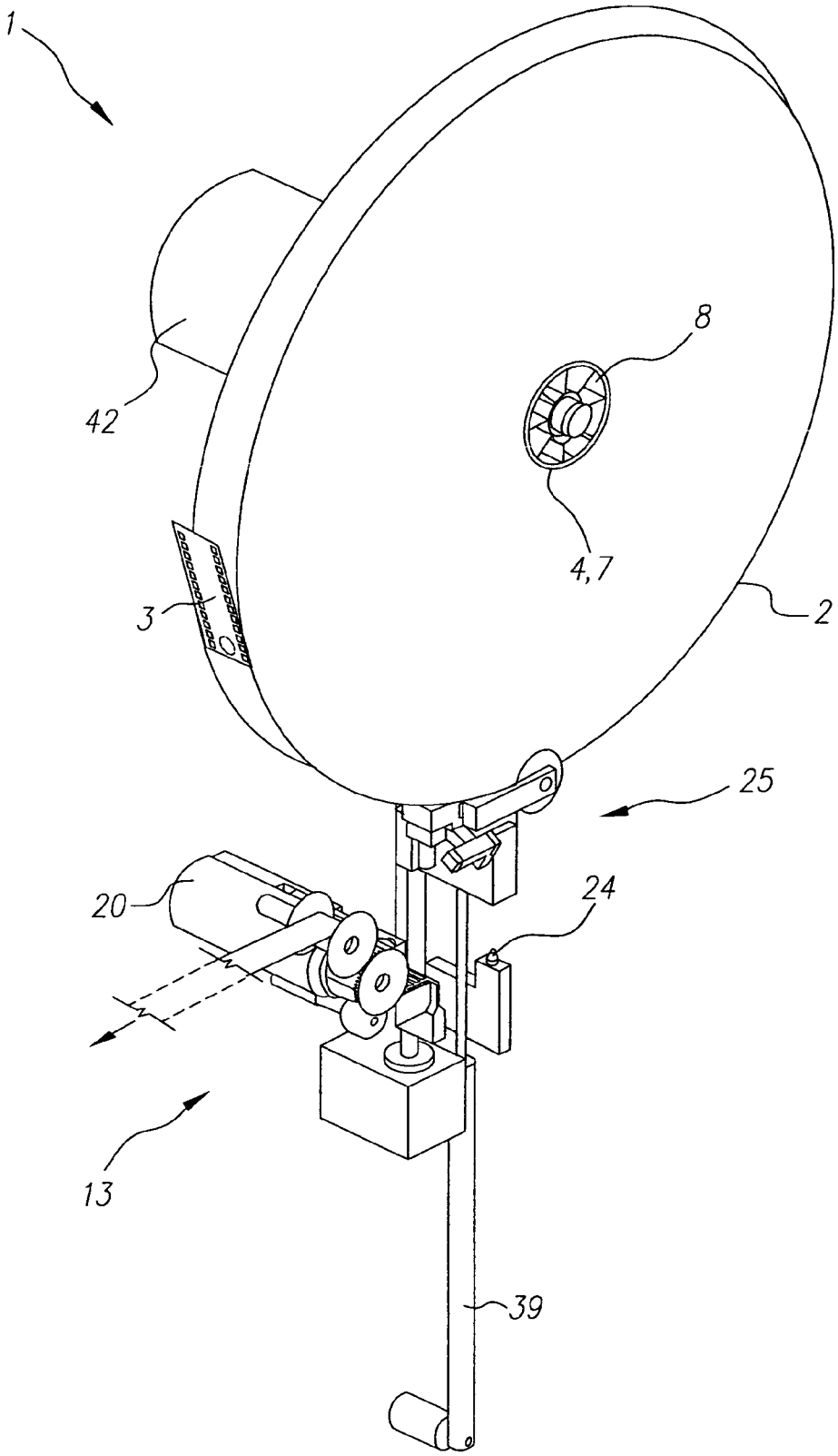
FIG. 4 is a perspective view of the automated web splicing system 1, with a web stock roll 2 on an unwind spindle 41 and the leader holder device 25 against the web stock roll 2.
Figure 5:
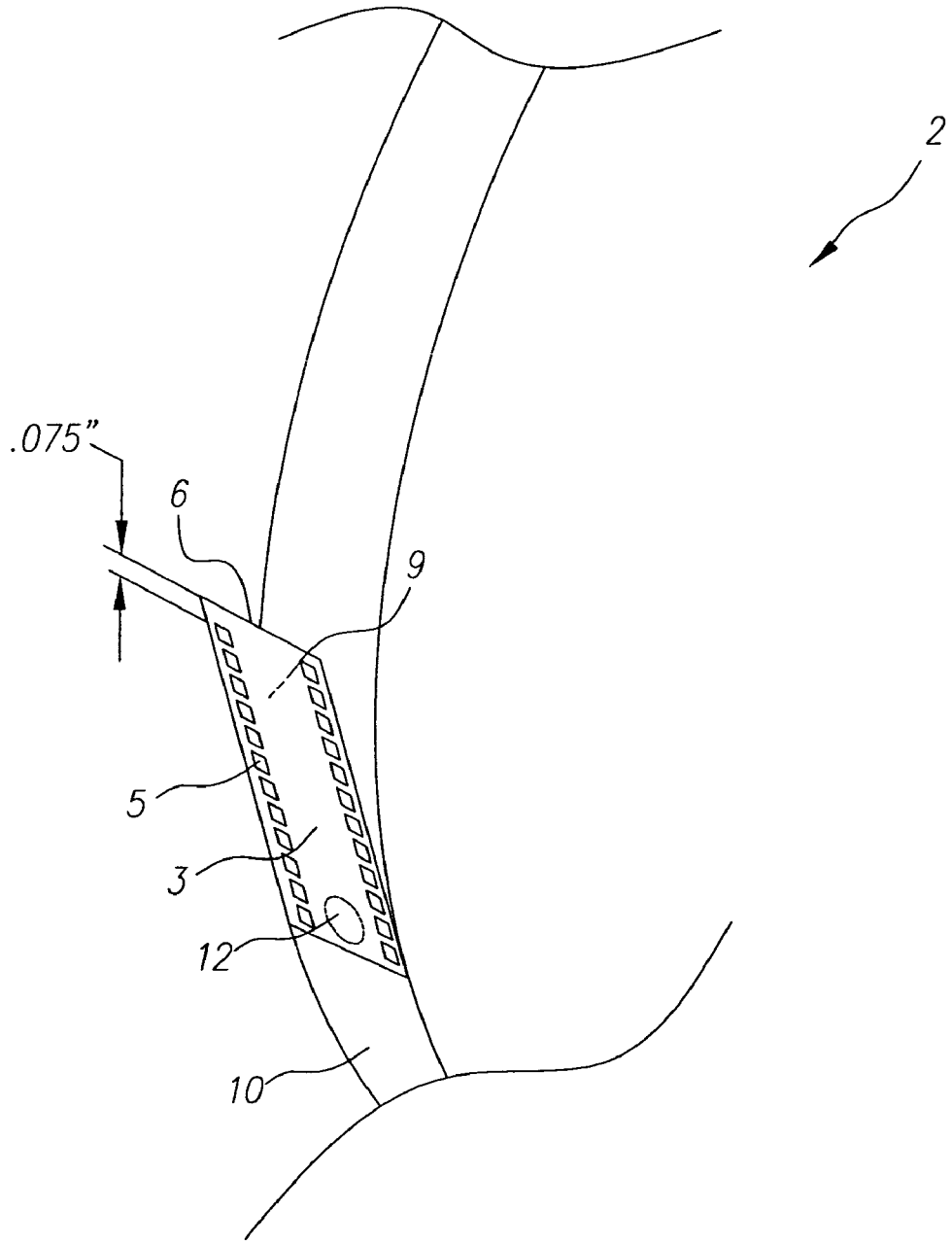
FIG. 5 is a close perspective view of the web stock roll 2, web leader 3, and leader adhesive 12.
Figure 15A:
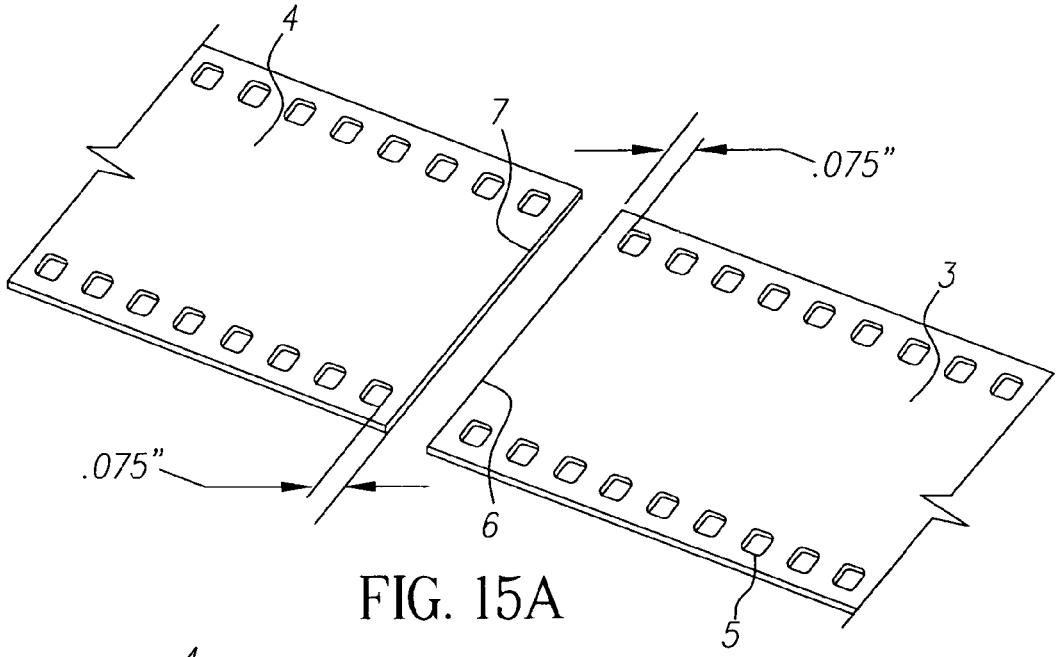
FIG. 15A is a perspective view of the web trailer 4 and web leader 3 of a web stock roll 2 before splicing.
Figure 15B:
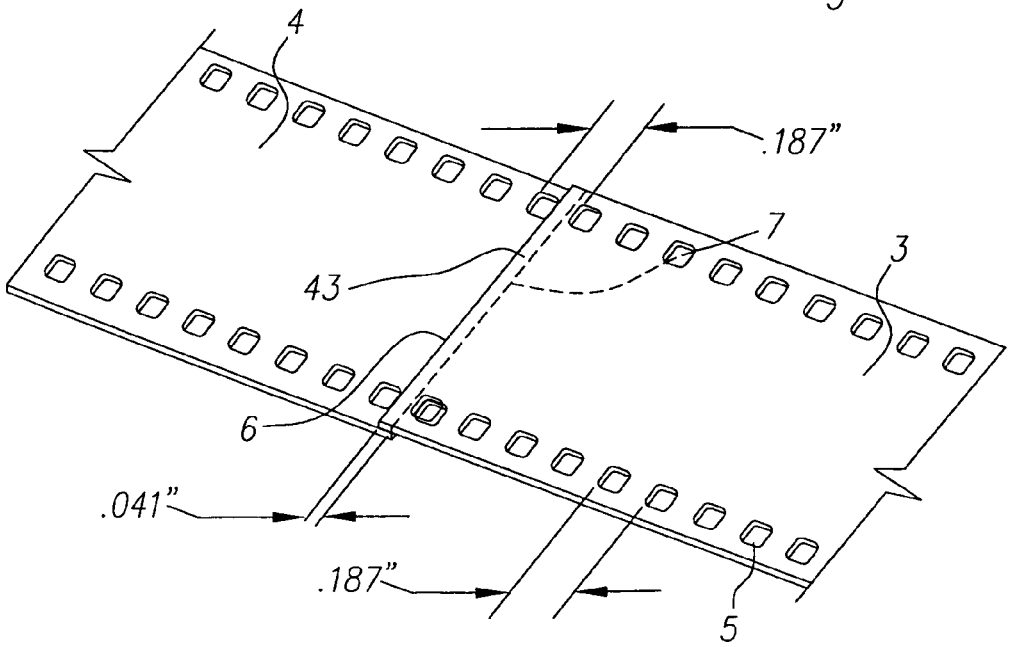
FIG. 15B is a perspective view of the webs in FIG. 15A after positioning for on-pitch splicing.

The automatic web splicing system 1 includes a web stock roll 2, further illustrated in FIGS. 4 and 5, which has a special loose flap web leader 3, that provides a means to locate, hold and position the stock roll web leader 3 for splicing. A leader adhesive 12 attached to the web leader 3 creates the loose leader flap. Also, both the web leader 3 and trailer 4 ends of the web stock roll 2 are accurately precut, relative to their adjacent perforations, so an accurate and repeatable splice 43 can be made, as seen in FIGS. 15A and 15B. No cutting or removal of web is required with the automatic web splicing system 1. The 0.075" dimension, seen in FIG. 5 and FIG. 15A, from the web leader edge 6 to the first adjacent perforations 5 is an example of the dimension that would be used for splicing 35 mm motion picture film (web). The 0.075" dimension would also be maintained for the web trailer edge 7 to its first adjacent perforations 5. Variations in this 0.075" dimension would directly affect the length of splice 43, which is overlapped; for example, having a 0.041" overlap dimension, as shown in FIG. 15B.

The loaded web stock roll 2 can be of varying diameters, and of varying rotational orientations when loaded onto the unwind spindle 41. The present invention is capable of automatically acquiring the web leader 3, and positioning the web leader 3 for splicing, when the web stock roll 2 is loaded in a random rotational orientation.

Both the web trailer 4 of the previous unwound web stock roll 2, and the web leader 3 of a new web stock roll 2, mounted to the unwind spindle 41, are accurately located via mechanical registration of perforations 5.

Unwind

Figure 8:
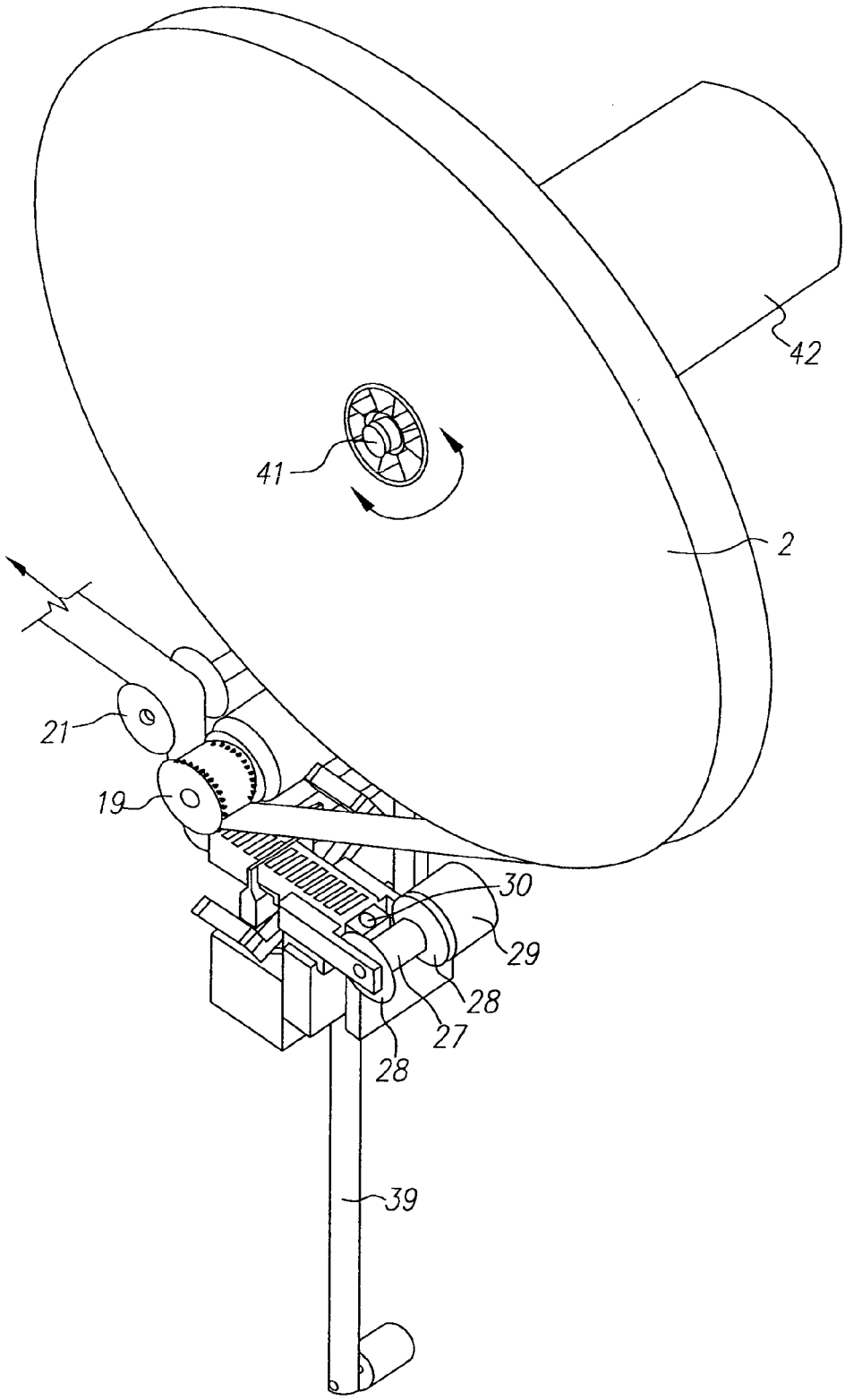
FIG. 8 is a perspective view illustrating steps 1, 2 and steps 31–33 in the automatic splicing process.
Figure 9:
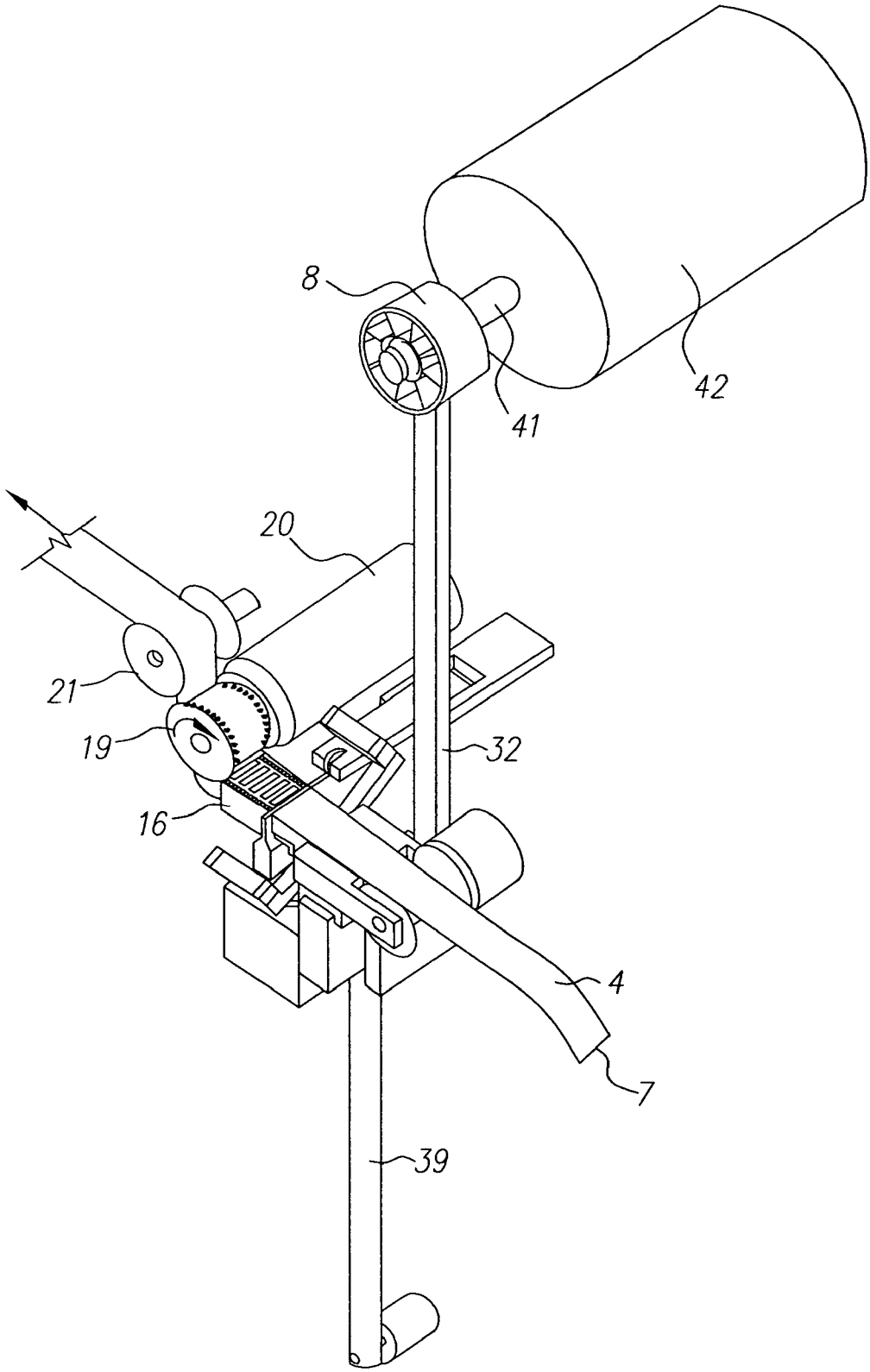
FIG. 9 is a perspective view illustrating steps 3–6 in the automatic splicing process.
Figure 10:
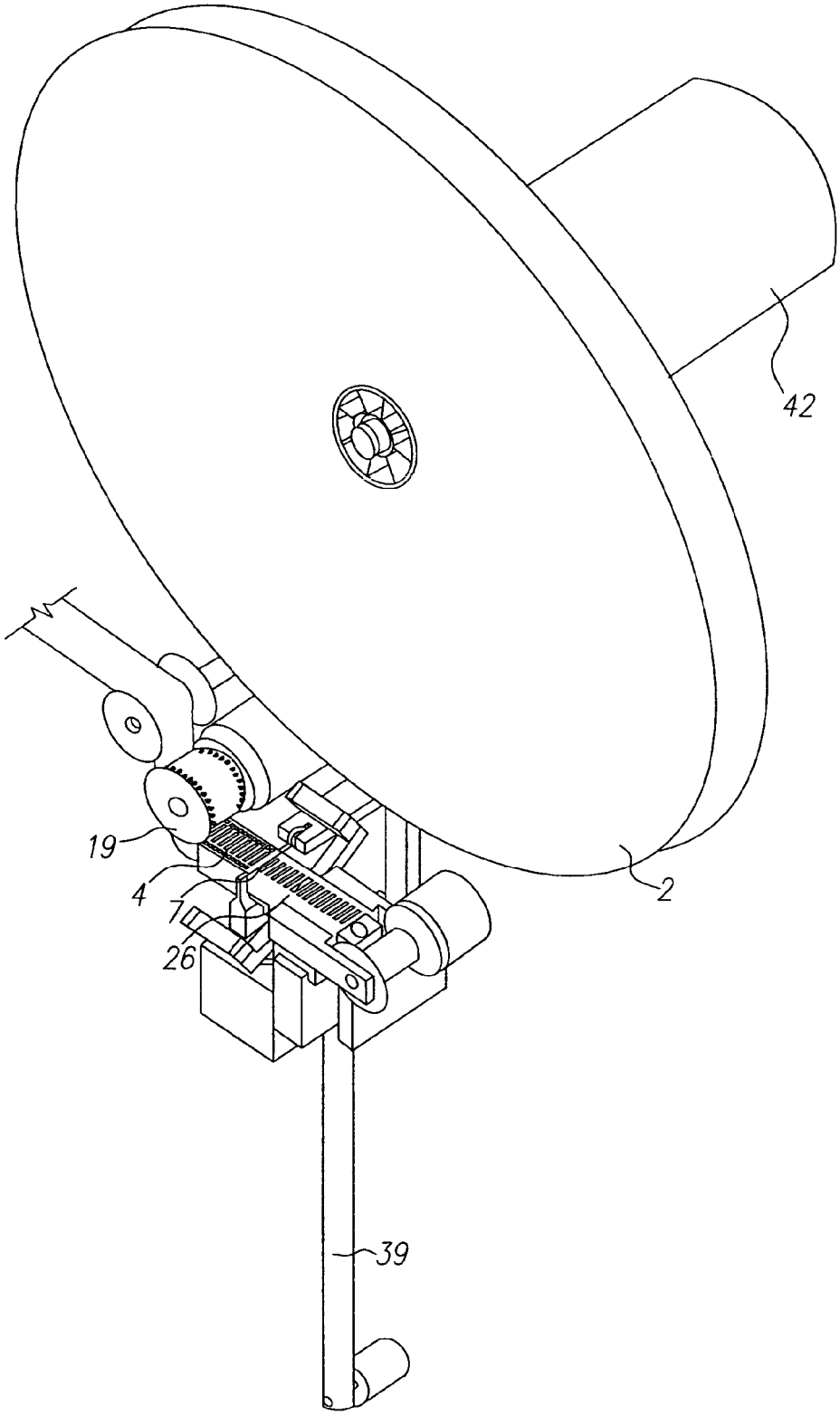
FIG. 10 is a perspective view illustrating steps 7–14 in the automatic splicing process.
Figure 11:
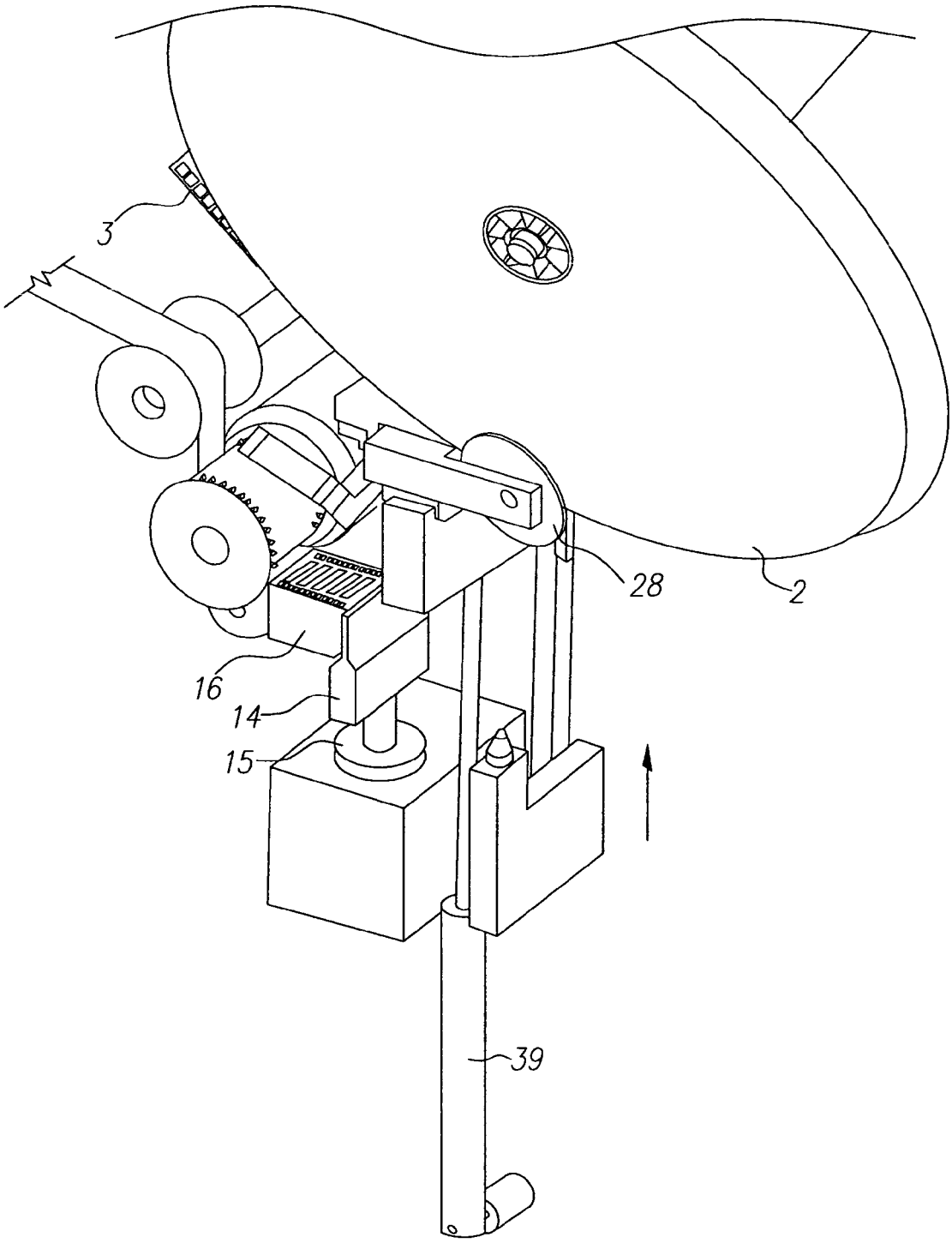
FIG. 11 is a perspective view illustrating steps 15–17 in the automatic splicing process.
Figure 12:
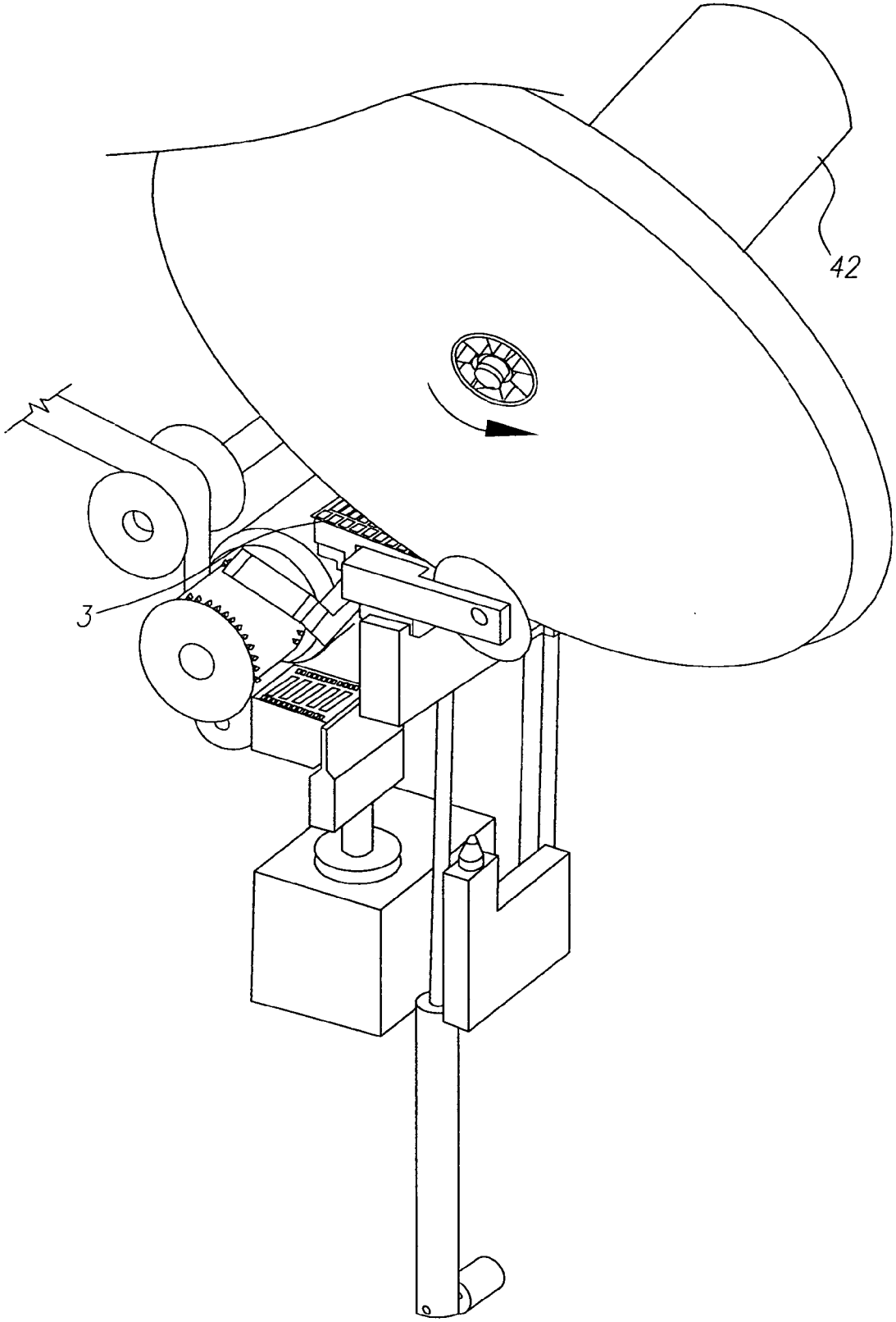
FIG. 12 is a perspective view illustrating steps 18–23 in the automatic splicing process.
Figure 13:
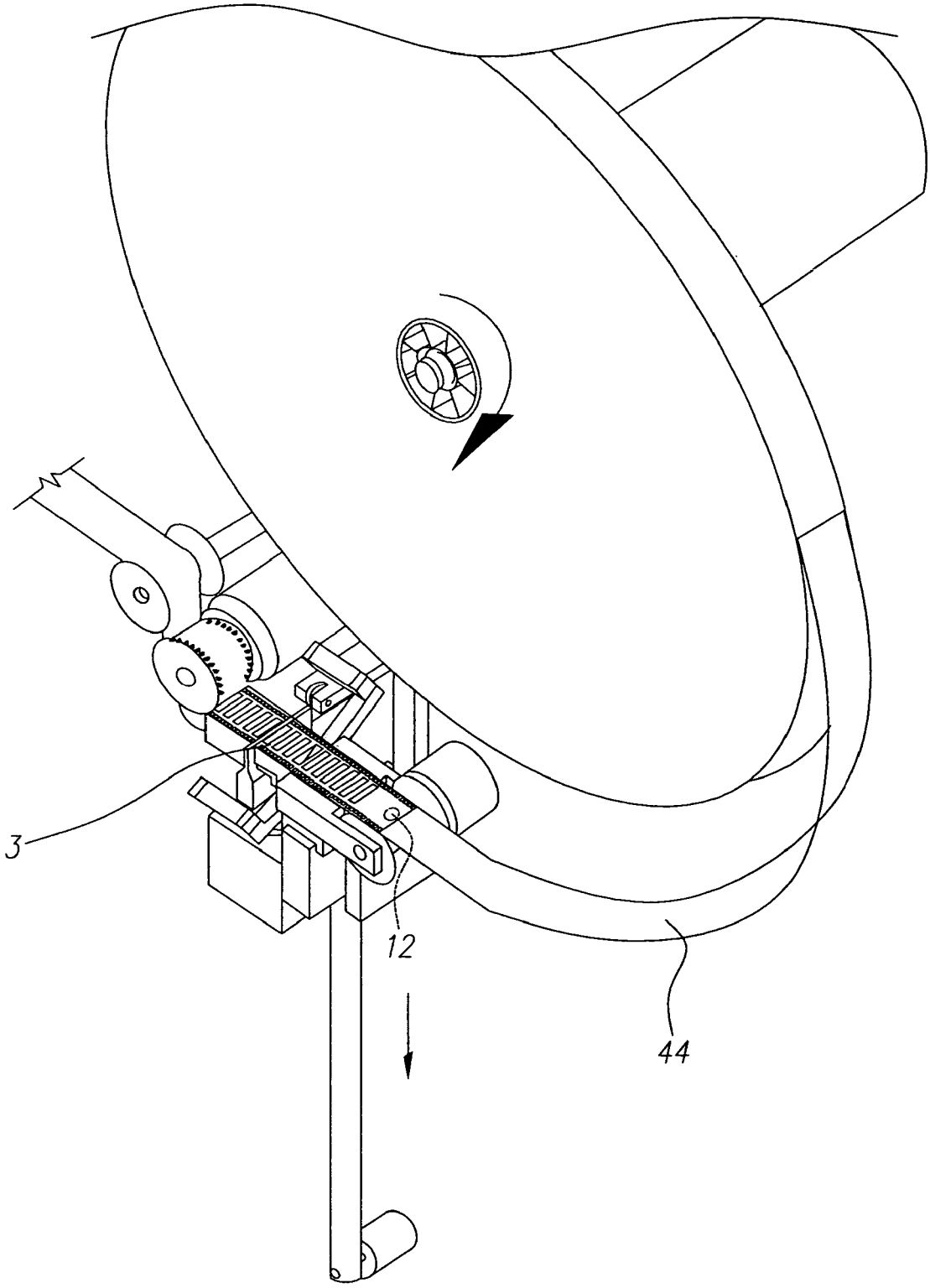
FIG. 13 is a perspective view illustrating steps 24–26 in the automatic splicing process.
Figure 14:
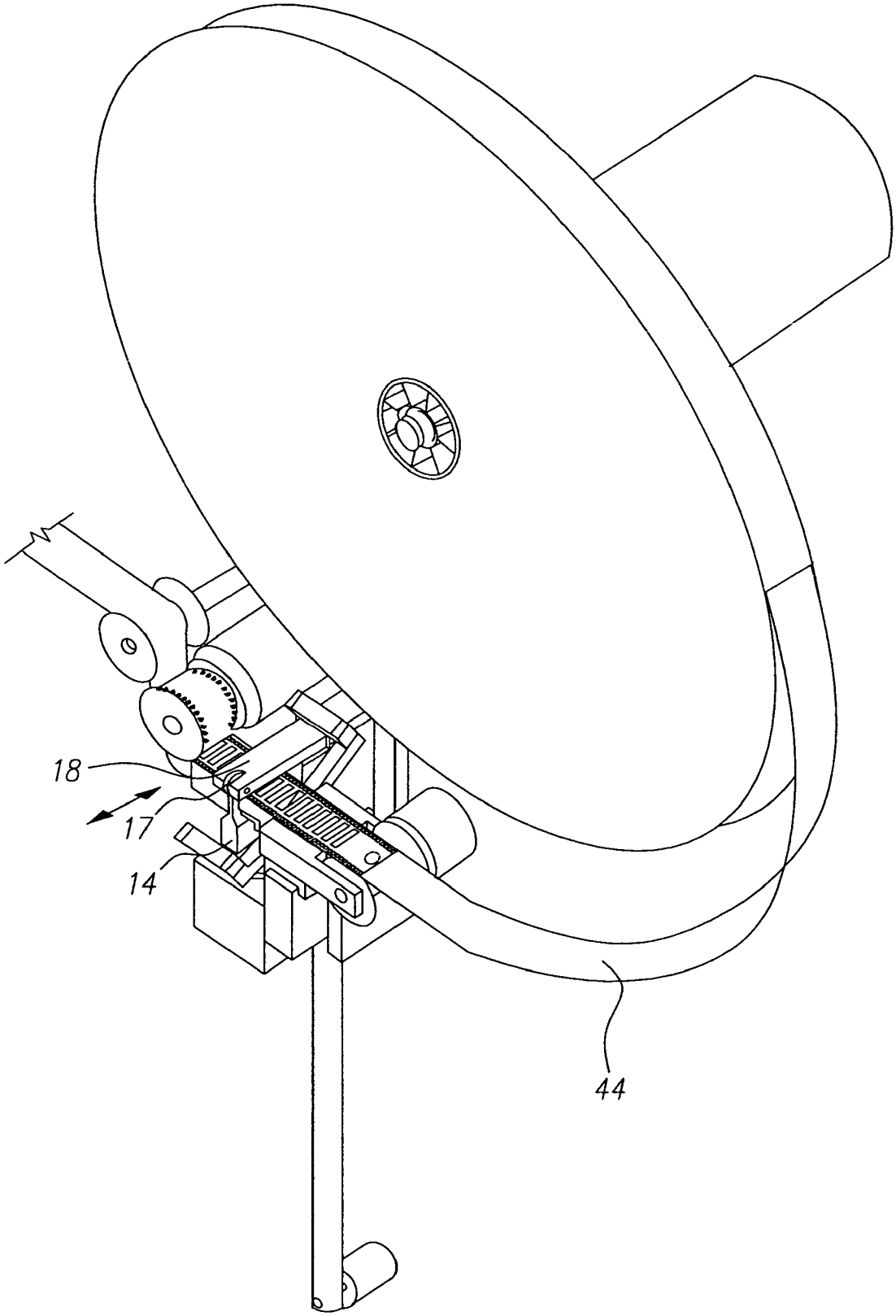
FIG. 14 is a perspective view illustrating steps 27–30 in the automatic splicing process.

The automated web splicing system1 has an unwind spindle 41, which is supported by a unwind drive 42 as seen in FIGS. 1 and 4. Unwind drive 42 is mounted to a frame (not shown) for the automated web splicing system 1. The unwind spindle 41 has a device (not shown), which can actively engage with the stock roll core 8. Unwind drive 42 can act as a brake of varying torques (e.g., in a torque mode providing a controlled web tension) or the unwind drive 42 can move web stock roll 2 to an accurate rotational position (in the position mode to locate the web leader 3). The web stock roll 2 can be loaded in any rotational orientation, but it should preferably unwind in the CW direction (as the present invention is configured). Refer to FIG. 8. An encoder 29 provides an accurate means to control the unwind drive 42 web positioning process when a moving idler roller 27 is engaged with a web stock roll 2.

Web Stock Roll

The web stock roll 2, seen in FIGS. 4 and 5, includes a roll or web 11 (such as motion picture film) wound onto a core 8, and a leader adhesive 12. The leader adhesive 12 is designed to hold the outer convolution of web to itself, and create a flap of web of a specific length at the web leader 3 end of the web stock roll 2. It is desirable to have the leader adhesive 12 peel cleanly off the roll, when the web leader 3 is pulled from the stock roll 2. It is also desirable to have the leader adhesive 12 remain adjacent to the web leader 3 when peeled (i.e., sticking to the web facing in side 9, and not the web side facing out 10). In this way, the leader adhesive 12 remains adjacent to the subsequently formed splice 43, shown in FIG. 7. The web trailer 4, which is cinched to the core 8, should also come off the core cleanly (without adhesive tape, or other items stuck to it, for example). Both the web leader edge 6 and the web trailer edge 7 should preferably be precut to a specific pre-determined dimension relative to the web perforations 5 to generate a splice 43 of a desired overlap length.

The leader adhesive 12 can be of many forms and shapes, for example:

- A label or tape with high tack adhesive on one side and low tack adhesive on the other
- A dot of adhesive
- A label with different amounts of adhesive on each side
- A folded over label
- A label with an adhesive dot
- A label with a folded over adhesive section And the leader adhesive is not limited to the alternatives listed above. Those skilled in the art, understand that variations in the leader adhesive 12 could provide the same function disclosed in the present invention.

Splicing Station

Figure 3:
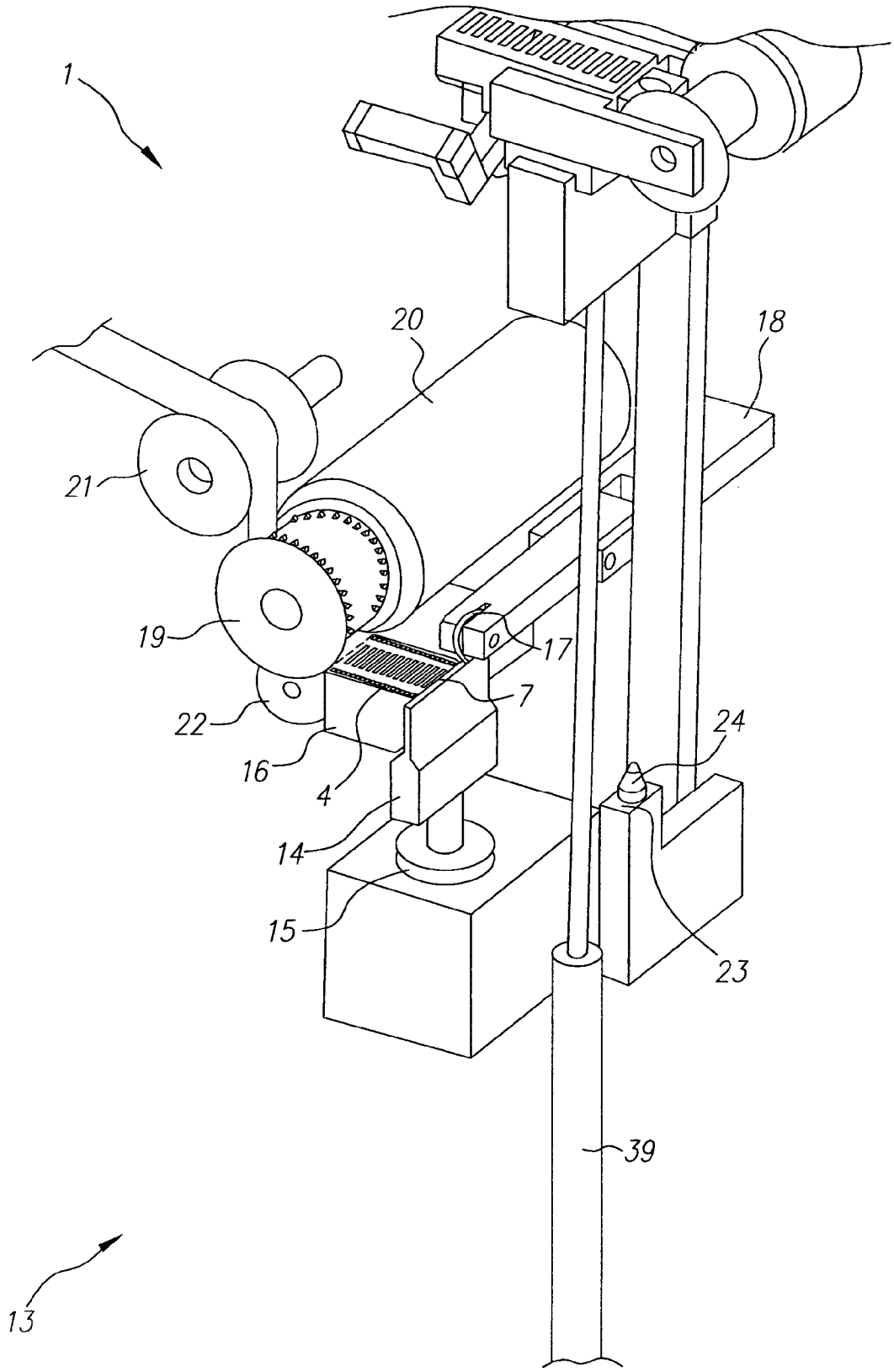
FIG. 3 is a close perspective view of a splicing station 13 with the web trailer 3 shown from the preceding operation, positioned ready for splicing.

An exemplary splicing station 13, shown in FIG. 3, includes an ultrasonic horn 14, actuated by a transducer 15, which is mounted to the system 1 frame (not shown). A splicing roller 17 is pivotally mounted and is spring loaded (by a means not shown) against the ultrasonic horn 14, and is actuated in the transverse direction by a splicing roller actuator 18 (the actuator means is not explicitly shown). Adjacent to the ultrasonic horn 14 is a fixed vacuum block 16, designed to hold a web trailer 4 flat at one side of the ultrasonic horn 14. The vacuum supplied to the vacuum block 16 can be energized on or off via a valve or other means. The vacuum pressure on the fixed vacuum block 16 can hold the web trailer 4 down, flat and tight for splicing, yet still allows the web to be pulled across the ultrasonic horn 14, when the web is under sufficient web tension.

Adjacent to the fixed vacuum block 16 is a web sprocket 19 designed to transport and position the web via its perforations 5. Sprocket 19 is driven by sprocket drive 20, which has accurate rotational positional control (an internal encoder). The sprocket drive 20 is mounted to the system 1 frame (not shown). Adjacent to sprocket 19 is a guide roller 22, which does not contact the sprocket or web during normal operation. However, the guide roller 22 maintains a slight gap between the sprocket 19 and itself to keep the web engaged with the sprocket 19, if there is no web tension on ether side of sprocket 19. A flanged idler 21 is pivotally mounted to the system 1 frame (not shown) and provides sufficient wrap of the web on sprocket 19, and also provides web guiding.

Figure 7:
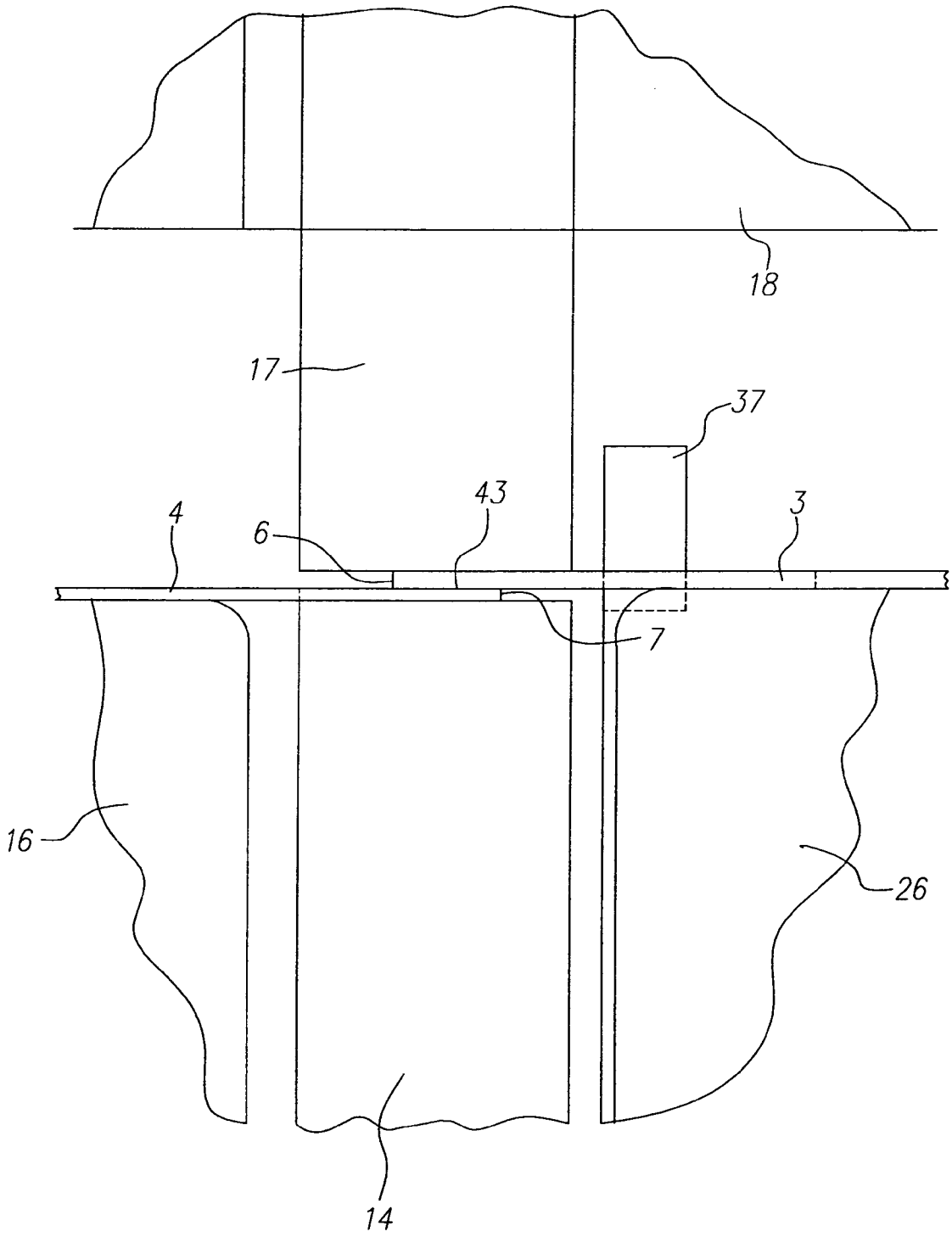
FIG. 7 is a close front view of the ultrasonic splicing station 13, splicing roller 17, horn 14, web leader and web trailer (3,4) and other adjacent tooling.

FIG. 7 illustrates the positions of the web leader 3, web trailer 4, and adjacent parts to the splice 43.

Also mounted to the system 1 frame (not shown) are a stop 23 and a locator pin 24, as seen in FIG. 3. Both the stop 23 and the locator pin 24 are used to position the leader holder device 25 when it is retracted to splicing station 13.

Leader Holder Device

Figure 2:
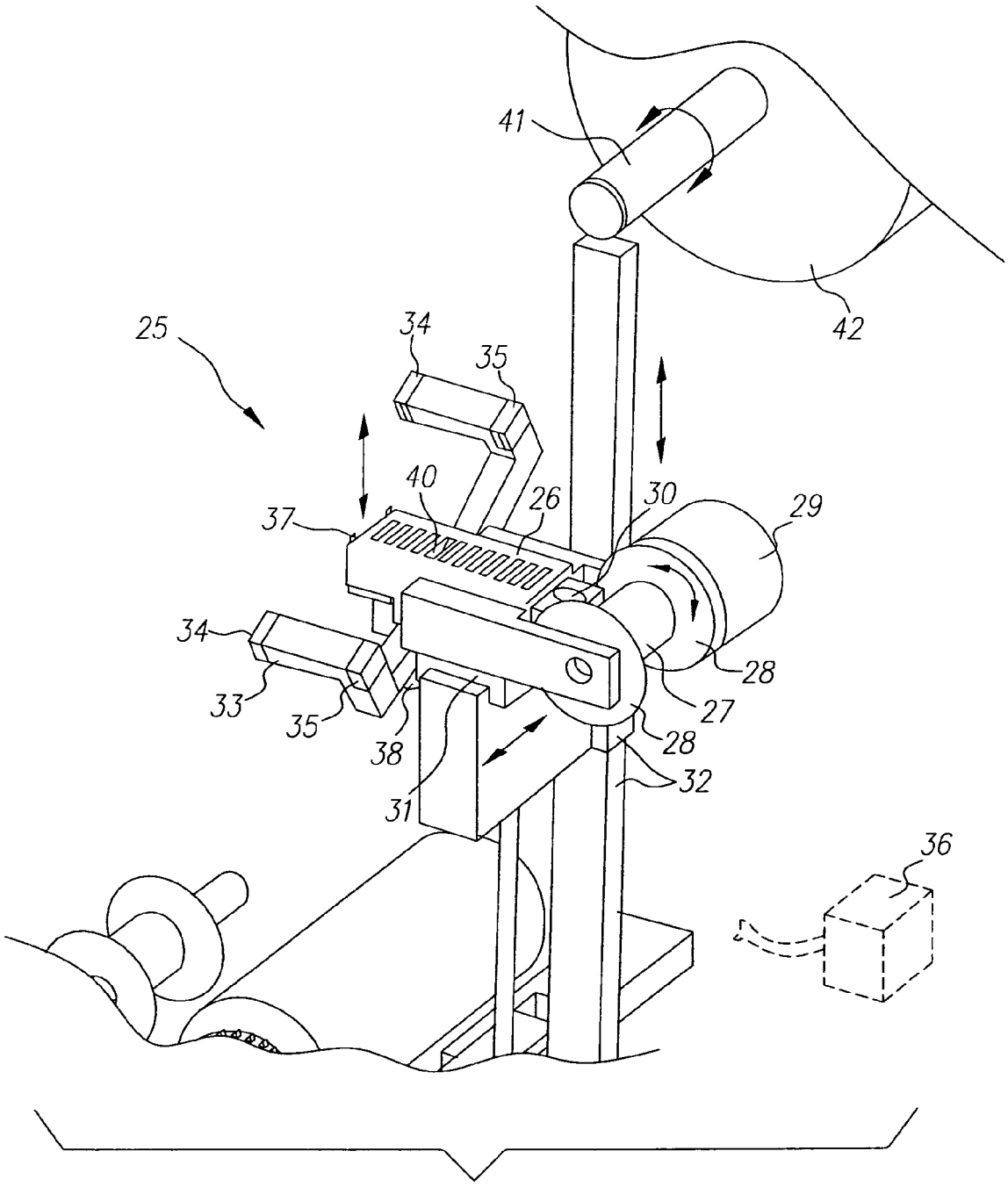
FIG. 2 is a close view of a leader holding device 25, also with a web and a web stock roll 2 removed for further clarity.
Figure 6:
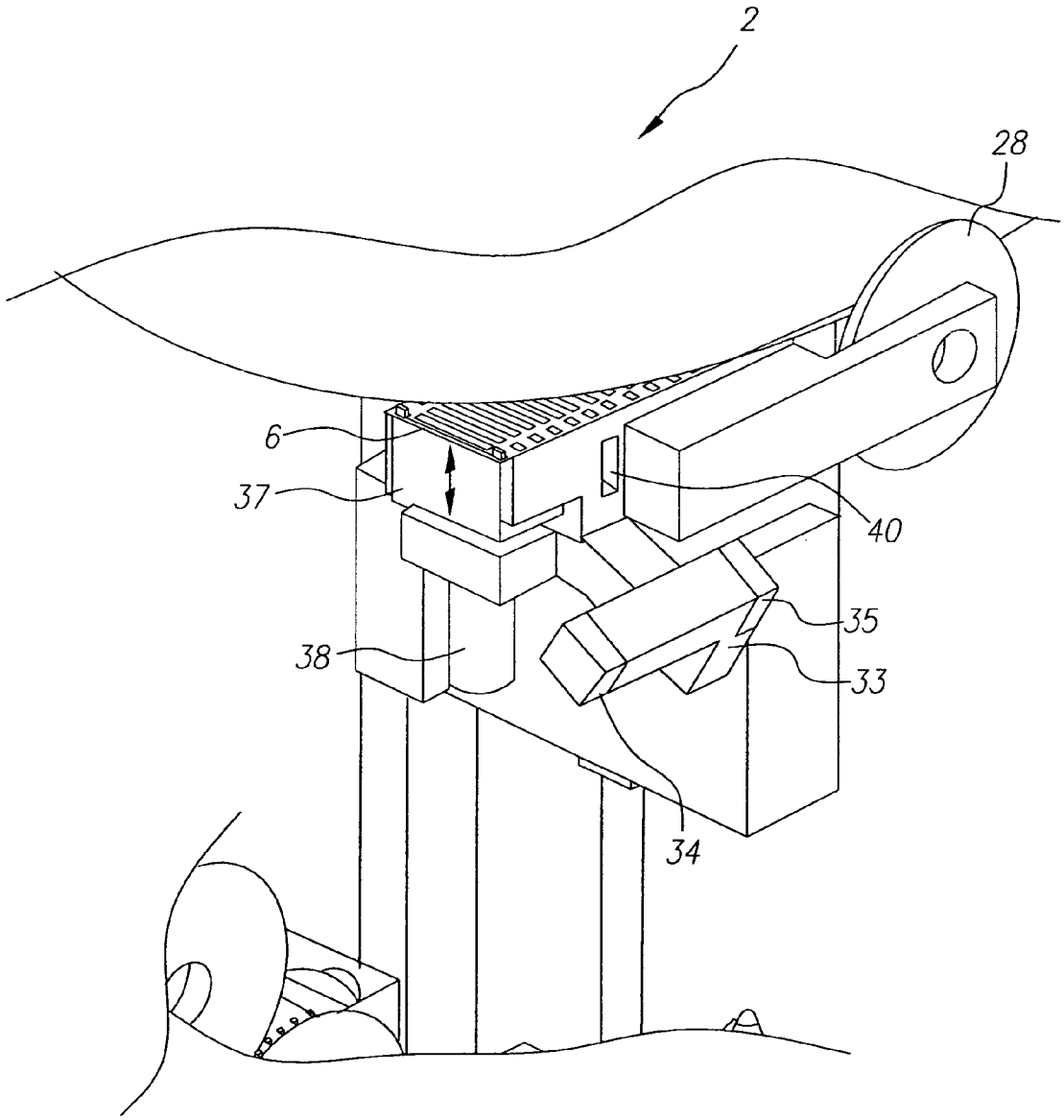
FIG. 6 is a close perspective view of the leader holder device 25 engaged with the web stock roll 2, and the web leader 3 engaged and positioned by a perforation tab 37.

A leader holder device 25, seen in FIGS. 1, 2 and 6, is actuated via a cylinder 39, under a controlled force, which is mounted pivotally to the system's 1 frame (not shown). The leader holder device 25 is supported by a vertical slide 32. The vertical slide 32 is also mounted to the system's 1 frame (not shown). In a retracted position, the leader holder device 25 is located against stop 23 and is also located transversely (across the width of the web) by locating pin 24. A slot 30, in the moving vacuum head 26, accurately engages with the locating pin 24. The moving vacuum head 26 and its associated parts are mounted to a lateral slide 31, therefore, they move to the locating pin's 24 fixed position when the leader holder device 25 is retracted.

In a forward position, the leader holder device 25 is positioned when the moving idler roller 27 contacts the web stock roll 2. The flanges 28 of the moving idler roller 27 contact the edges of the roll of web 11, and position the moving vacuum head 26 in the transverse direction. This feature provides accurate lateral location of the web leader 3 on the moving vacuum head 26, even if the web stock roll 2 sidewall varies in flatness or the web stock roll's 2 lateral position varies on the unwind spindle 41.

An encoder 29, which supports the moving idler 27, is used as a position input signal for the unwind drive 42. Attached to the moving vacuum head 26 is a sensor bracket 33, which holds two pairs of infrared-through beam sensors 34 and 35, which can be used safely for most light sensitive webs. Leader edge sensor 34 detects the web leader edge 6 of the new loaded stock roll 2 of web. Trailer edge sensor 35 detects the web trailer edge 7 of the previous unwound web stock roll 2, when the leader holder device 25 is at the splicing station 13. NOTE: the moving vacuum head 26 has a sensor clearance slot 40, so the sensors pair 34 and 35 can see through the vacuum head 26. Vacuum sensor 36 detects whether the web leader 3 seals off the vacuum pressure into the moving vacuum head 26 to sense that the web leader is flat on the moving vacuum head 26. Similar to the fixed vacuum block 16, when the web is under sufficient web tension, the moving vacuum head 26 can hold web leader 3 flat and tight for splicing, while still allowing the web to be pulled across it.

Also attached to the leader holder device 25 is a perforation tab 37 designed to easily fit through two perforations when actuated by perforation tab actuator 38, as shown in FIG. 6. When the web leader 3 and its corresponding perforations 5 are pulled against the perforation tab 37 under a sufficient tension provided from the unwind drive 42, the web stalls, and the web leader 3 is accurately positioned according to its corresponding perforations 5.

A manual method or an automated device to unload empty cores 8 and load new web stock rolls 2 onto the unwind spindle 41 are also functions in the overall process, but are not illustrated, because those skilled in the art understand how to provide a wide range of means to enable these interfacing functions to the present invention.

VARIATIONS OF THE PRESENT INVENTION

Some variations in the present invention are worth noting.

Although the present invention illustrates a web with two rows of perforations 5, which extend the entire length of the roll of web 11, a web having a single row or more than two rows of perforations 5 could be accommodated by a variation of the present invention.

There are several variations in the present invention, which one could consider. The leader holder device 25 consists of an encoder 29, which supports the moving idler 27, and is used as a position input signal for the unwind drive 42. Instead, the moving idler 27 could be supported by a drive with an integrated encoder, which could drive the idler 27 and in turn drive the web stock roll 2 when engaged. This variation in the present invention would then allow the unwind drive 42 to be replaced by a rotational brake, which would provide web tension when the web is advanced by the sprocket drive 20.

Another variation in the present invention, which one could consider, is eliminating the perforation tab 37 and the associated perforation tab actuator 38. This variation in the present invention would then only use the leader edge sensor 34 to detect the position of the web leader edge 6 and then advance the web leader 3 to the correct location on the moving vacuum head 26, to ensure the correct position of the perforations 5 and web leader edge 6. Although this variation would simplify the system, one would lose the mechanical registration means to locate the perforations.

Often it is difficult to use ultrasonic splicing processes with some web materials, or with dissimilar web materials. In this case a variation of the present invention could be considered, such as using an adhesive between the web leader and web trailers. Or, an adhesive tape or adhesive label could be used to connect the two webs together.

The present invention uses an "overlap" ultrasonic slicing process to achieve the desired splice 43. A variation, which could be considered, is to generate a splice wherein the web leader of the wound stock roll web is not overlapping (often called a butt splice) with the web trailer of the unwound stock roll leader. The web leader and trailer edges (3,4) of the web stock roll 2 would be cut to a specific dimension from their adjacent perforations 5 to facilitate such a "non-overlapping" splice. The web leader and web trailer would be spliced on pitch, with a connecting splice material, such as an adhesive splice tape or adhesive label.

In the present invention, a slot 30 incorporated within the moving vacuum head 26 interfaces with a locating pin 24, which is part of the splicing station 13. A variation in the present invention, which could be considered, would be to include a slot feature, similar to slot 30 in the moving vacuum head 26, and to place the locating pin 24 in the moving vacuum head 26. By inverting these features, the same locating capability can be achieved.

Controls

Basic control functions of the Present Invention:

Moving vacuum head (vacuum, on/off)
Fixed vacuum block (vacuum, on/off)
Vacuum sensor (web leader detection)
Web leader edge sensor (sense web leader edge)
Web trailer edge sensor (sense web trailer edge)
Moving idler roller encoder (web leader and web stock roll
position and stock roll diameter measurement)
Perforation tab actuator (engage/retracted)
Leader holder device cylinder (engage/retracted)
Ultrasonic horn transducer (on/off)
Splicing roller (forward/backward)
Sprocket drive (web feed and web trailer positioning at splicing station)
Unwind drive (web stock roll torque brake, positioning web leader, and creating slack loop of web)

Additional functions used in overall process; but not functions of automated splicing process:

Unwind spindle (engage/disengage)
Empty core (remove)
Web stock roll (load)

The exemplary steps of operation for acquiring the web leader 3 from a web stock roll 2, accurately positioning the web leader 3 and the web trailer 4 of another web at an ultrasonic station 13, and ultrasonic sealing these webs together, are illustrated in FIGS. 8–14, and are described as follows:

1 At the end of the unwinding of the web stock roll 2, the sprocket drive 20 reduces the web speed and feeds the web at a constant rate. (Refer to FIG. 8)
2 The vacuum pressure on the fixed vacuum block 16 and moving vacuum head 26 is energized. (Refer to FIG. 8)
3 The web trailer 4 from the expiring unwinding web stock roll 2 comes completely off its associated core 8. (Refer to FIG. 9)
4 The web trailer 4 is pulled against the fixed vacuum block 16 and moving vacuum head 26 by the vacuum pressure. (Refer to FIG. 9)
5 The vacuum sensor 36 senses when the web trailer 4 is flat against the moving vacuum head 26. (Refer to FIG. 9)
6 The web trailer 4 is pulled slowly across the moving vacuum head 26 and fixed vacuum block 16, via the sprocket 19 and its associated sprocket drive 20. (Refer to FIG. 9)
7 The web trailer edge 7 pulls across the moving vacuum head 26. (Refer to FIG. 10)
8 The vacuum sensor 36 senses end of web trailer 4 is close to trailer edge sensor 35. (Refer to FIG. 10)
9 The trailer edge sensor 35 senses the web trailer edge 7. (Refer to FIG. 10)
10 Vacuum on the moving vacuum head 26 is turned off. (Refer to FIG. 10)
11 The sprocket 19 and its associated sprocket drive 20 feeds the web trailer 4 to the splicing position. (Refer to FIG. 10)
12 The empty web core 8 is removed from the unwind spindle 41 by a means not shown. (Refer to FIG. 10)
13 A new web stock roll 2 is loaded onto the unwind spindle 41 by a means not shown. (Refer to FIG. 10)
14 The unwind spindle 41 engages the core 8 by a means not shown. (Refer to FIG. 10)
15 The leader holder device 25 is actuated by cylinder 39, against the web stock roll 2. (Refer to FIG. 11)
16 The web stock roll 2 is rotated by the unwind drive 42 CCW a specific angle, which in turn rotates the encoder 29 a resulting angle, to measure the web stock roll 2 diameter. (Refer to FIG. 11)
17 The web stock roll 2 continues to rotate CCW at a slow constant web speed, and the vacuum pressure is turned on the moving vacuum head 26. (Refer to FIG. 11)
18 The web leader 3 of web stock roll 2 engages with the moving vacuum head 26. (Refer to FIG. 12)
19 The vacuum sensor 36 senses the web leader 3 is flat against the moving vacuum head 26. (Refer to FIG. 12)
20 The unwind drive 42 slowly rotates the web leader 3 across the moving vacuum head 26, and the web leader edge 6 is pulled past the trailer edge sensor 34, which detects the web leader edge 6. (Refer to FIG. 12)

21 The web leader 3 and its adjacent perforations 5 are stopped in location for the perforation tab 37 to engage. (Refer to FIG. 12)

22 The perforation tab 37 is actuated through the perforations 5 without contacting the perforations 5. (Refer to FIGS. 6 and 12)

23 The unwind drive 42 is put into a controlled torque mode in the CCW direction, causing the associated perforations 5 to pull against the perforation tab 37. When the associated perforations 5 are tugged against the perforation tab 37, the unwind drive 42 stalls. The web leader 3 is now mechanically positioned accurately on the moving vacuum head 26 via its associated perforations 5. (Refer to FIG. 12)

24 The unwind drive 42 goes into a position mode, and rotates CW a specific amount to create the desired slack loop of web 44. (Refer to FIG. 13)

25 The leader holder device 25 retracts to the splicing station 13 stop 23, and in the process of this motion peels the leader adhesive feature 12 from the outer convolution of stock roll 2. (Refer to FIG. 13)

26 The ultrasonic horn 14 is energized. (Refer to FIG. 14)

27 The splicing roller 17 rolls forward over the overlap of the web leader and trailer edges (6,7) to create an ultrasonic seal. (Refer to FIGS. 7 and 14)

28 The ultrasonic horn 14 is deactivated. (Refer to FIG. 14)

29 The splicing roller 17 returns to its initial position, and the perforations tab 37 is retracted. (Refer to FIG. 14)

30 The vacuum pressure is turned off on the moving vacuum head 26 and fixed vacuum block 16. (Refer to FIG. 14)

31 The unwind drive 42 rotates the web CCW to take up the slack loop of web 44 and to pull the splice 43 and adjacent web off the horn 14, fixed vacuum block 16 and moving vacuum head 26. (Refer to FIG. 8)

32 The unwind drive 42 goes into torque mode to provide web tension for unwinding. (Refer to FIG. 8)

33 The sprocket 19 and its associated sprocket drive 20 conveys the web forward into the waiting process, while the unwind drive 42 provides a desired braking torque. (Refer to FIG. 8)

In FIGS. 16A–D a process flow diagram is shown of an automatic perforated web splicing system, which implements the present invention. An ultrasonic splicer is used to create the desire splice in this process flow diagram.

Figure 16A:
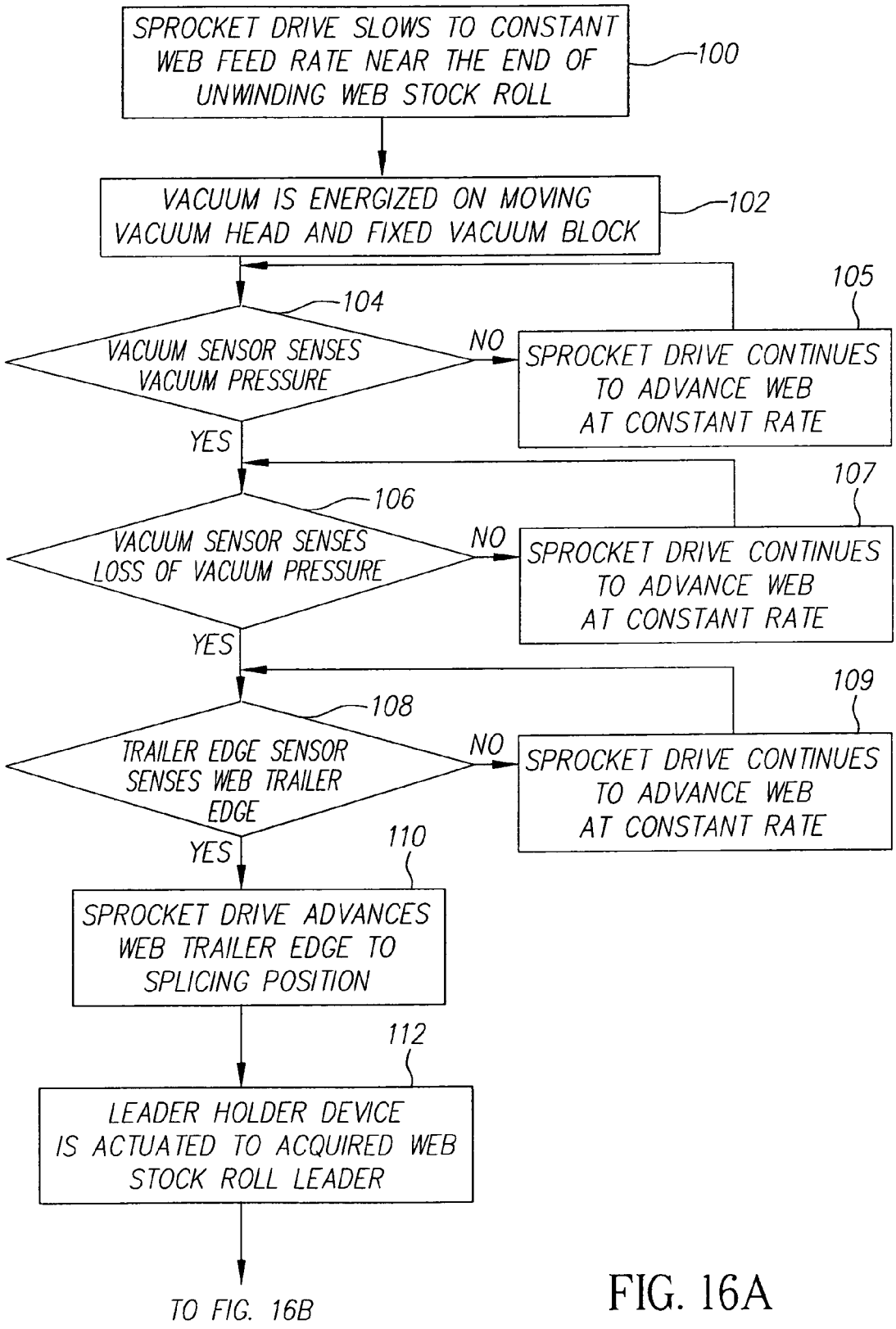
FIG. 16A is the beginning of an exemplary process flow diagram of an automatic perforated web splicing system, which implements the present invention.

As seen in FIG. 16A, and in block 100, the sprocket 19 and its associated sprocket drive 20 are unwinding the web from a web stock roll 2. The unwind drive 42 is providing a braking torque to maintain web tension between the sprocket 19 and the web stock roll 2. Near the end of the web stock roll 2, unwinding the web feed is slowed to a constant controlled rate.

In block 102 the vacuum pressure is energized in the moving vacuum head 26, which is positioned at the splicing station 13. Vacuum pressure is also energized in the fixed vacuum block 16.

In diamond 104 the state of the vacuum sensor 36, which is connected to the moving vacuum head 26, is monitored. If vacuum pressure is not seen, the sprocket drive 20 continues to advance web at a constant rate, as shown in block 105.

If the vacuum sensor 36 sees vacuum pressure, the system again looks at the state of the vacuum sensor 36 as seen in diamond 106. If the vacuum pressure is still seen, the sprocket drive 20 continues to advance web at a constant rate, as shown in block 107. If the vacuum pressure in the moving vacuum head 26 is not seen, then this indicates that the web trailer edge 7 is moving across the moving vacuum head 26 and is approaching the trailer edge sensor 35.

In diamond 108 the state of the trailer edge sensor 35, which detects the web trailer edge 7, is monitored. It the trailer edge sensor 35 continues to see the web, the sprocket drive 20 continues to advance web at a constant rate, as shown in block 109. When the trailer edge sensor 35 sees its transition in state, and senses the web trailer edge 7, the sprocket drive 20 then advances the web a specific length to position the web trailer edge 7 at the splicing location, as seen in block 110.

Now the web trailer 4 of the unwound stock roll 2 is positioned and held securely in place at the splicing station 13, in preparation for splicing. In block 112, the leader holder device 25 is actuated to engage the web stock roll 2.

Figure 16B:
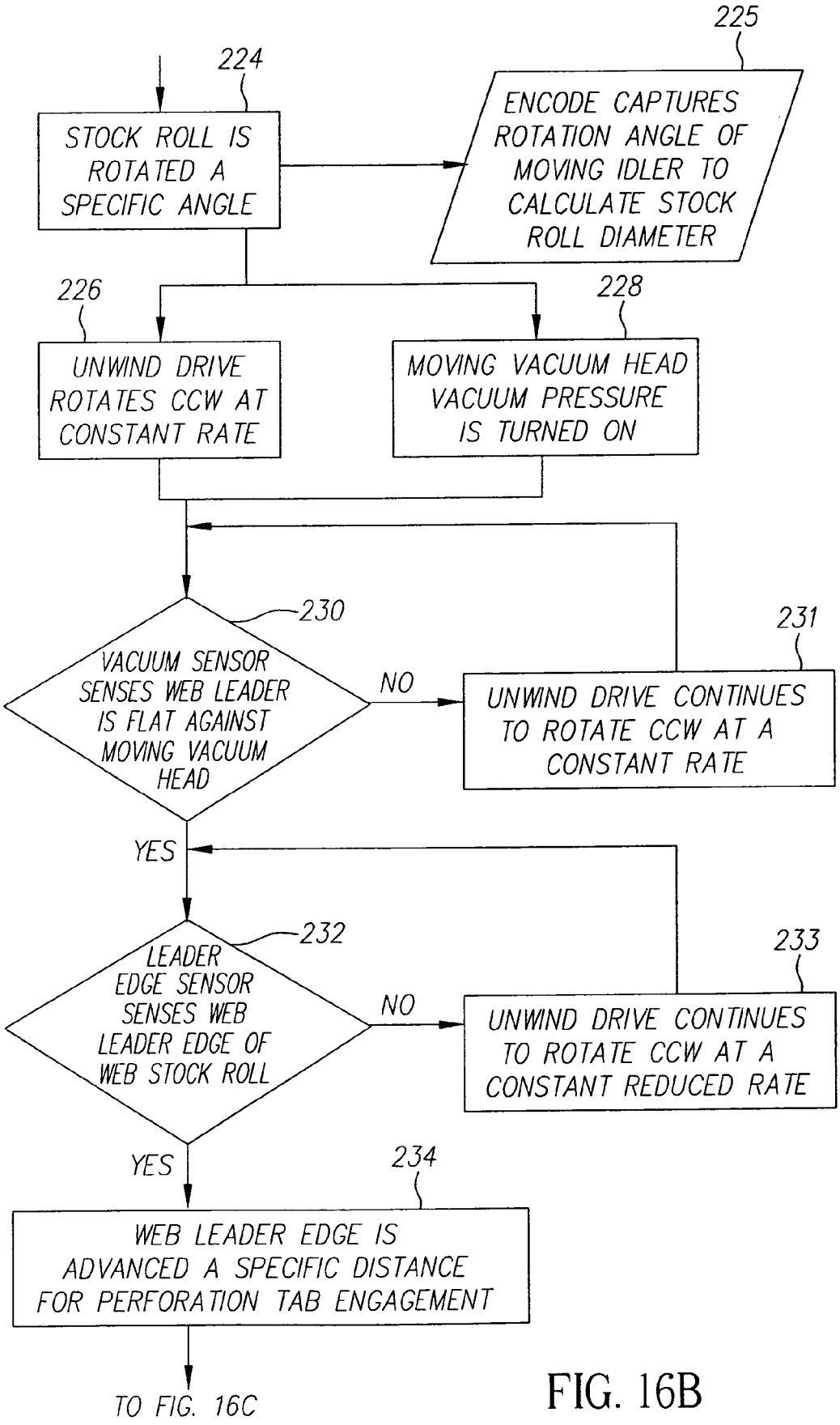
FIG. 16B is a continuation of the exemplary process flow diagram seen in FIG. 16A, of an automatic perforated web splicing system, which implements the present invention.

Continuing in FIG. 16B, and in block 224, the unwind drive 42, in the position mode, rotates web stock roll CCW a specific angle, which in turn rotates the moving idler roller 27 and its associated encoder 29 a resulting amount. The encoder rotation angle is captured and this data is used to calculate the web stock roll diameter as seen in parallelogram 225. It is necessary to determine the web stock roll diameter for the unwind drive 42 to have good positional and torsion control of the web stock roll 2 and the web leader 3.

In block 226 the unwind drive 42 continues to rotate CCW at a controlled rate. And as seen in block 228, the vacuum pressure to the moving vacuum head 26 is turned on.

In diamond 230 the state of the vacuum sensor 36, which is connected to the moving vacuum head 26, is monitored. If vacuum pressure is not seen, the unwind drive 42 continues to advance rotate the web stock roll 2 at a controlled constant rate, as shown in block 231. If vacuum pressure is seen, this indicates the web leader 3 of the web stock roll 2 is flat against the moving vacuum head 26.

Next, in diamond 232 the state of the leader edge sensor 34 is monitored. If web is seen by the leader edge sensor 34, the unwind drive 42 continues to advance the web leader across the moving vacuum head 26 as shown in 233. When the leader edge sensor 34 sees its transition in state, and senses the web leader edge 6, the unwind drive 42 then advances the web a specific length and stops, to position the perforations adjacent to the web leader edge 6 to align with the perforation tab 37 as seen in block 234.

Figure 16C:
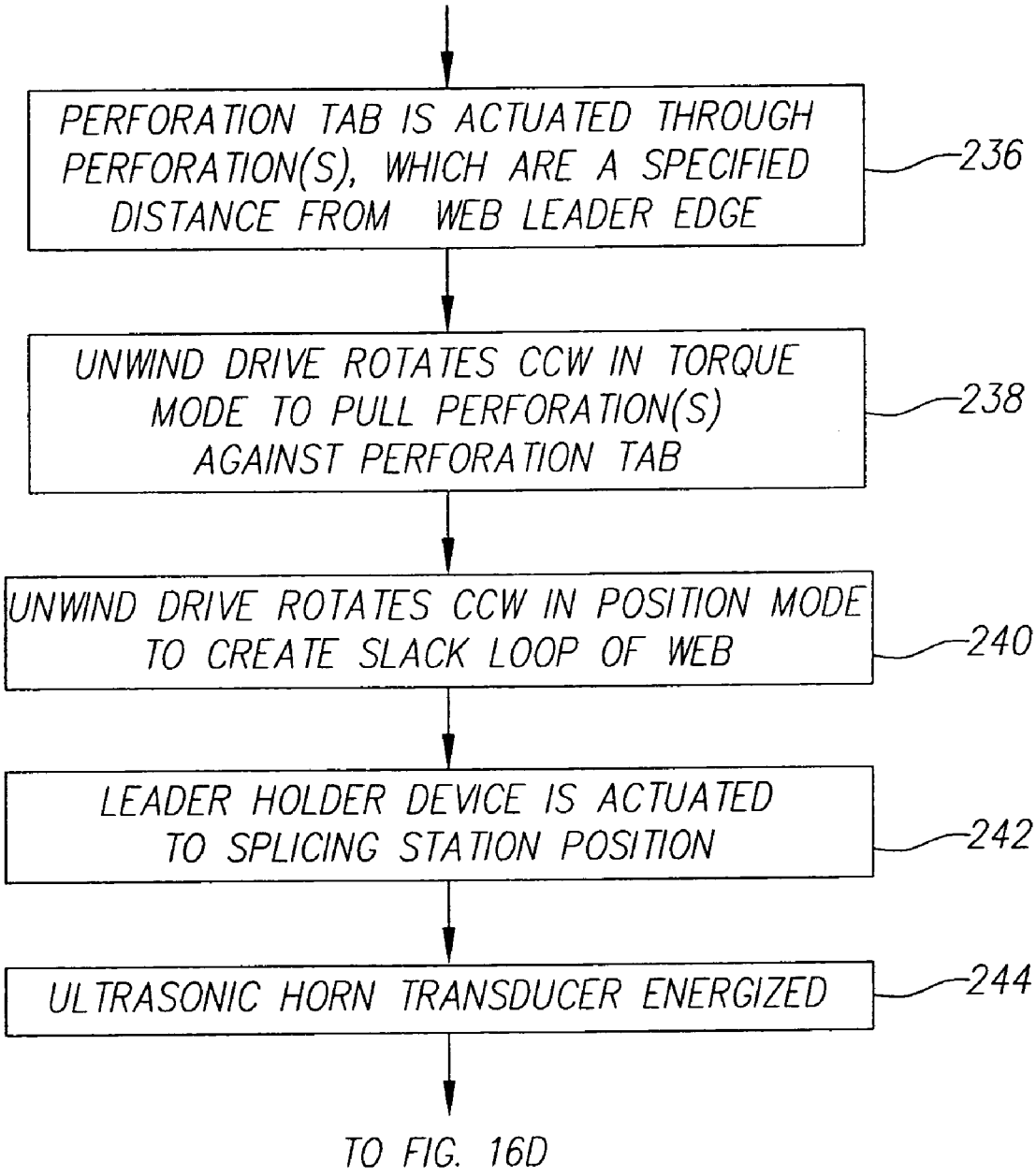
FIG. 16C is a continuation of the exemplary process flow diagram seen in FIG. 16B, of an automatic perforated web splicing system, which implements the present invention.

Continuing in FIG. 16C, and in block 236, the perforation tab 37 is actuated through the perforation(s) 5. Then unwind drive 42 is put in a controlled torque mode, and pulls the web leader perforations 5 against the perforation tab 37, which stalls the unwind drive 42, as seen in block 238.

In block 240, the unwind drive 42 rotates CW to create a slack loop of web 44. The leader holder device 25 is then retracted to the locator pin 24 and stop 23, at the splicing station 13, as shown in block 242.

Now both the web leader 3 and web trailer 4 are in a prepared position for splicing. In block 244 the ultrasonic horn transducer 15 is energized.

Figure 16D:
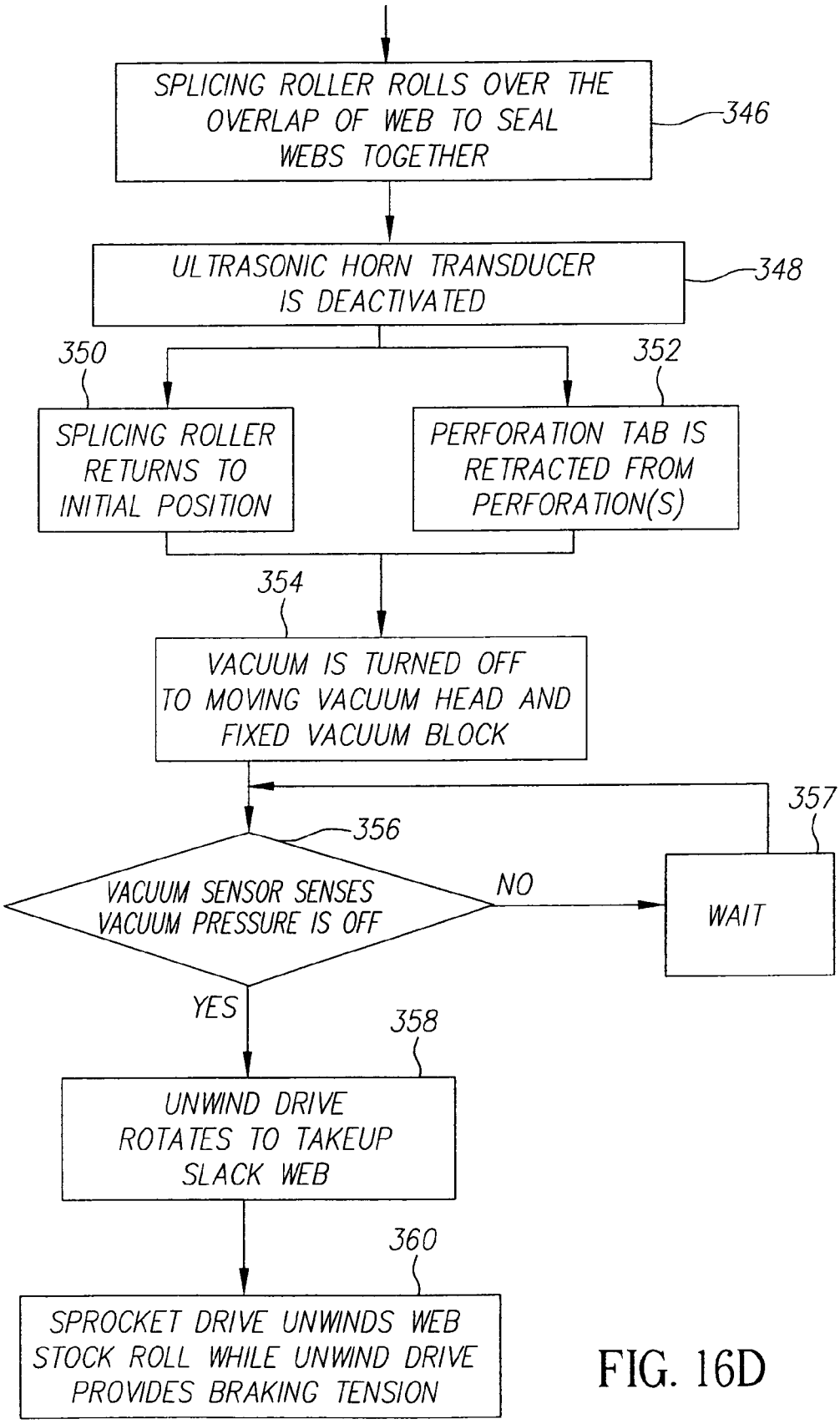
FIG. 16D is a continuation of the exemplary process flow diagram seen in FIG. 16C, of an automatic perforated web splicing system, which implements the present invention.

Continuing in FIG. 16D, and in block 346, the splicing roller 17 is actuated forward over the overlap of web ends sealing the webs together. In block 348 the ultrasonic horn transducer 15 is deactivated. And then in block 350 the splicing roller 17 actuated back to its initial position, while in block 352 the perforation tab 37 is retracted, clearing the associated perforations 5.

In block 354, the vacuum pressure is turned off in the moving vacuum head 26 and in the fixed vacuum block 16.

And in diamond 356, the vacuum pressure is monitored in the moving vacuum head 26. If vacuum pressure is still present, as indicated by the vacuum sensor 36, then the system waits as shown in 357. When the vacuum sensor 36 senses that the vacuum pressure is gone, the unwind drive 42 rotates to take up the slack loop of web 44, as shown in block 358.

Finally, in block 360 the sprocket drive 20 and the associated unwind drive 42, in a braking torque mode, begins unwinding the stock roll.

PARTS LIST

1 automated web splicing system
2 web stock roll
3 web leader
4 web trailer
5 perforations
6 web leader edge
7 web trailer edge
8 core
9 web side facing in
10 web side facing out
11 roll of web
12 leader adhesive
13 splicing station
14 horn
15 transducer
16 fixed vacuum block
17 splicing roller
18 splicing roller actuator
19 sprocket
20 sprocket drive
21 idler
22 guide roller
23 stop
24 locator pin
25 leader holder device
26 moving vacuum head
27 moving idler roller
28 flanges
29 encoder
30 slot
31 lateral slide
32 vertical slide
33 sensor bracket
34 leader edge sensor
35 trailer edge sensor
36 vacuum sensor
37 perforation tab
38 perforation tab actuator
39 cylinder
40 sensor clearance slot
41 unwind spindle
42 unwind drive
43 splice
44 slack loop of web
100 operating step
102 operating step
104 operating step
105 operating step
106 operating step
107 operating step
108 operating step
109 operating step
110 operating step
112 operating step
224 operating step
225 operating step
226 operating step
228 operating step
230 operating step
231 operating step
232 operating step
233 operating step
234 operating step
236 operating step
238 operating step
240 operating step
242 operating step
244 operating step
346 operating step
348 operating step
350 operating step
352 operating step
354 operating step
356 operating step
357 operating step
358 operating step
360 operating step

What is claimed is:

1. An automated perforated web splicing system, comprising:

a) a web stock roll of a perforated web supported on a sole unwind spindle and having both a precut web leader and a web trailer prior to splicing, wherein the perforated web has a corresponding pitch for each perforation;

b) a movable leader holder device supported by a slide for automatically, without manual intervention during operation of the splicing system, acquiring and positioning the web leader of the web stock roll according to perforations in the perforated web upon actuation of a cylinder that provides a controlled force to the movable leader holder; and c) a splicing station including a sprocket rotationally driven by a sprocket drive mounted to a frame of the splicing system for automatically, without manual intervention during operation of the splicing system, positioning the web trailer prior to splicing and performing an on pitch splice according to perforations in the perforated web.

2. The system claimed in claim 1, wherein the web stock roll includes a leader adhesive for holding an outer convolution of the perforated web to itself.

3. The system claimed in claim 1, wherein the movable leader holder device comprises:

b1) a movable vacuum head for automatically acquiring and supporting a web leader of a loaded and wound web stock roll;

b2) a movable idler roller for positioning the movable leader holder device against the web stock roll;

b3) a slide and cylinder for enabling the movable leader holder device to be aligned with the splicing station; and b4) a slot incorporated within the movable leader holder device for enabling the movable leader holder device to be aligned with the splicing station.

4. The system claimed in claim 1, wherein the splicing station further comprises:

c1) a fixed vacuum block, adjacent to the sprocket, for automatically supporting a web trailer of a previously unwound web stock roll;

c2) a splicing means for splicing the web leader and web trailer together; and c3) a stop and a locator pin for positioning the movable leader holder device at the splicing station.

5. The system claimed in claim 4, wherein the splicing means is selected from the group consisting of an ultrasonic splicer, an adhesive tape splicer, adhesive label splicer, and an adhesive splicer.

6. A movable leader holder for automatically acquiring and positioning a web leader of a perforated web stock roll, in a splicing station, corresponding to perforations in the perforated web stock roll, comprising:

a) a movable vacuum head for automatically acquiring, without manual intervention during operation of the splicing station, and supporting the web leader of a loaded and wound perforated web stock roll;

b) a movable idler roller that simultaneously positions the leader holder in two directions against the perforated web stock roll, such that in a first direction the movable idler roller contacts an outer diameter of the perforated web stock roll, and simultaneously in a second direction, the movable idler roller provides lateral positioning of the movable leader holder in alignment with sidewalls of the perforated web stock roll; and c) means for aligning the movable leader holder with the splicing station.

7. A splicing station, comprising:

a) a sprocket and mounted sprocket drive for automatically, without manual intervention during operation of the splicing station, positioning a web trailer by engaging one or more perforations in a perforated web according to perforation pitch of the one or more perforations;

b) a fixed vacuum block, adjacent to the sprocket, for automatically, without manual intervention during operation of the splicing station, supporting a web trailer of a previously unwound web stock roll;

c) a stop and a locator pin mounted on a frame of the splicing station and used together for positioning a movable leader holder device at the splicing station; and d) means for splicing the web leader and web trailer together.

8. A method for automatically positioning the web trailer prior to splicing and performing an on pitch splice according to perforations in a perforated web, comprising the steps of:

a) reducing web speed of a sole unwinding web stock roll;

b) energizing a fixed vacuum block and movable vacuum head;

c) pulling a web trailer from an expiring web stock roll against the fixed vacuum block and movable vacuum head;

e) moving a leader holder device against the web stock roll;

f) energizing the movable vacuum head;

g) engaging a web leader of a new stock roll with the movable vacuum head;

h) pulling a web leader edge as the web leader moves across the movable vacuum head;

i) determining location for the web leader to engage one or more perforation tabs according to adjacent perforations;

j) stalling an unwind drive as perforations are engaged with the perforation tabs;

k) rotating the unwind drive to produce a slack loop of web;

l) positioning the leader holder device to peel a leader adhesive from the web stock roll; and m) performing the splice and all of the previous steps above without manual intervention.

* * * * *